US009521871B2

(12) United States Patent
Bolla

(10) Patent No.: US 9,521,871 B2
(45) Date of Patent: Dec. 20, 2016

(54) DIGNITY HOSPITAL GOWN

(76) Inventor: Leela R. Bolla, Naples, FL (US)

( * ) Notice: Subject to any disclaimer, the term of this patent is extended or adjusted under 35 U.S.C. 154(b) by 182 days.

(21) Appl. No.: 13/025,494

(22) Filed: Feb. 11, 2011

(65) Prior Publication Data

US 2012/0204317 A1 Aug. 16, 2012

(51) Int. Cl.
*A41D 13/00* (2006.01)
*A41D 13/12* (2006.01)

(52) U.S. Cl.
CPC ..... *A41D 13/1245* (2013.01)

(58) Field of Classification Search
CPC ..... A41D 13/1245
USPC ..... 2/114, 83, 121, 78.4, 96, 104, 270, 211/48,2/49.1, 51, 52; 128/849, 852, 853, 128/854
See application file for complete search history.

(56) References Cited

U.S. PATENT DOCUMENTS 302,901 A * 8/1884 Fenne ..... 2/114
1,564,897 A * 12/1925 Sanborn ..... 2/48
1,731,137 A * 10/1929 Jones ..... 2/74
1,766,272 A * 6/1930 Vallier ..... 2/114
1,821,185 A * 9/1931 Luery ..... 2/74
1,967,369 A * 7/1934 Repitsky ..... 2/48
2,212,719 A * 8/1940 Prouty ..... 2/93
2,336,008 A * 12/1943 Goodman ..... 2/114
2,922,164 A * 1/1960 Liff ..... 2/49.2
3,276,036 A * 10/1966 Cater et al. ..... 2/114
3,748,659 A * 7/1973 Meyers ..... 2/74
4,458,365 A * 7/1984 Wood ..... 2/104
4,570,268 A 2/1986 Freeman
4,608,719 A * 9/1986 Lunt ..... 2/114
4,686,715 A 8/1987 Price
4,759,083 A 7/1988 Belcher
4,964,173 A 10/1990 Gordon et al.
4,975,984 A * 12/1990 Sting ..... 2/114
5,133,086 A * 7/1992 Truitt et al. ..... 2/114
D336,968 S * 7/1993 Russano ..... D2/720
5,274,852 A * 1/1994 Hogan ..... 2/114
5,440,763 A * 8/1995 Shah et al. ..... 2/114
5,454,119 A * 10/1995 Thomm ..... 2/114
5,553,323 A * 9/1996 Chou et al. ..... 2/114
D376,679 S * 12/1996 Edens et al. ..... D2/733
5,640,715 A * 6/1997 Adams ..... 2/46
5,956,763 A * 9/1999 Blackshear ..... 2/49.1
5,991,923 A * 11/1999 Maria ..... 2/83
6,012,166 A * 1/2000 Burbidge ..... 2/83
6,032,288 A * 3/2000 Simone ..... 2/69
D438,365 S * 3/2001 Mattrasingh ..... D2/841
6,216,269 B1 * 4/2001 Smith et al. ..... 2/46
6,256,788 B1 * 7/2001 Loewer et al. ..... 2/49.2
6,272,685 B1 * 8/2001 Kumar ..... 2/114

(Continued)

*Primary Examiner* — Khaled Annis
(74) *Attorney, Agent, or Firm* — Livingston Loeffler, P.A.; Edward M. Livingston, Esq.; Bryan L. Loeffler, Esq.

(57) ABSTRACT

A hospital gown including separable portions is provided. The hospital gown includes a one piece back panel, a two piece front panel, and left and right shoulder panels which cooperatively define a neck opening and left and right arm openings. The hospital gown includes an apron adapted to extend over at least a portion of the two piece front panel. The apron includes a left edge and a right edge detachably connected to the back panel or to the front panel. The shoulder panels include a plurality of fasteners to detachably connect the shoulder panels to the two piece front panel. The two piece front panel includes a right panel and a left panel and a telemetry pocket included thereon.

8 Claims, 6 Drawing Sheets

(56) References Cited

U.S. PATENT DOCUMENTS

| | | | | |
|---|---|---|---|---|
| 6,378,136 | B2 * | 4/2002 | Matsushita | 2/114 |
| 6,484,321 | B1 * | 11/2002 | Shamam | 2/114 |
| 6,694,521 | B1 * | 2/2004 | Hopkins | 2/83 |
| 7,073,204 | B1 * | 7/2006 | Boyles | 2/114 |
| 7,181,773 | B1 * | 2/2007 | Piraka | 2/114 |
| 7,305,716 | B1 | 12/2007 | Richards | |
| 7,665,151 | B1 * | 2/2010 | Finell | 2/49.1 |
| 2006/0037124 | A1 * | 2/2006 | Cho et al. | 2/114 |
| 2006/0277655 | A1 * | 12/2006 | Kerr | 2/114 |
| 2007/0130668 | A1 * | 6/2007 | Berman et al. | 2/114 |
| 2010/0095424 | A1 | 4/2010 | Grgich et al. | |

* cited by examiner

DIGNITY HOSPITAL GOWN

BACKGROUND OF THE INVENTION

The present invention relates to garments worn by medical patients, and more particularly to garments worn by medical patients in hospitals, clinics and other treatment facilities.

Numerous types of medical garments are currently in use. Existing medical garments generally have one or more different folds or openings to allow access to the patient for treatment or observation, while also allowing some degree of privacy. These garments are generally provided by the hospital, clinic or other treatment facility during the course of a patient's stay. These garments are relatively inexpensive, and are known to exhibit modest durability over repeated washings.

Despite their widespread acceptance, existing medical garments suffer from a number of shortcomings. For example, a number of existing medical garments include rear panels extending from the neck opening to the hem. One or more ties can secure left and right rear panels together. With such medical garments, however, the patient generally dons the gown in reverse to fasten the ties. In addition, the left and right rear panels frequently part, often causing the patient embarrassment and discomfort.

Accordingly, there remains a need for an improved medical garment which can be worn comfortably by a patient, yet still provide medical staff with access to the patient's body without the need for disrobing. In particular, there remains a need for an improved medical garment that can be quickly and conveniently secured about a patient while also preserving patient dignity and privacy throughout a hospital stay.

SUMMARY OF THE INVENTION

A hospital gown including separable portions is provided. The hospital gown includes a back panel, two front panels, and left and right shoulder panels that cooperatively define a neck opening and left and right arm openings. The shoulder portions include a plurality of fasteners to detachably connect the shoulder panels to the front portions. The hospital gown includes an apron adapted to extend over at least a portion of the front panels. The apron includes a left edge and a right edge detachably connected to the back panel or to the front panels.

In one embodiment, the front panels include a front top edge, a front bottom edge, a front left edge and a front right edge. In this embodiment, the front panels define a generally vertical opening between the left front edge and the right front edge. Optionally, the generally vertical opening extends from the front top edge to the front bottom edge to define a left front panel and a right front panel.

In another embodiment, the apron extends over a substantial portion of the generally vertical opening in the front panels. The apron can define an opening dimensioned to allow passage of the apron over the head of a wearer. The apron can alternatively include an upper left edge and an upper right edge each being detachably connectable to the left and right shoulder panels.

In still another embodiment, the shoulder panels each include a plurality of snaps to join the shoulder panels to the front panels. The front panels can include a telemetry pocket. In addition, one or more ties can extend from the left front panel and one or more corresponding ties can extend from the right front panel to releasably join the left front panel to the right front panel.

Embodiments of the invention can provide a hospital gown permitting medical examination and treatment by unfastening any of the various closures and by folding back any of the various panels. Accordingly, the hospital gown provides isolated access to specific portions of the patient's body. The hospital gown may be worn by both ambulatory patients and non-ambulatory patients, and may be manufactured in different sizes.

These and other advantages and features of the invention will be more fully understood and appreciated by reference to the description of the current embodiments and the drawings.

DESCRIPTION OF THE CURRENT EMBODIMENTS

The current embodiments relate to hospital gowns worn by medical patients for treatment, observation and other purposes. The embodiments can generally include a one piece back panel, a two piece front panel, left and right shoulder panels, and an apron adapted to extend over at least a portion of the two piece front panel.

Figure 1:
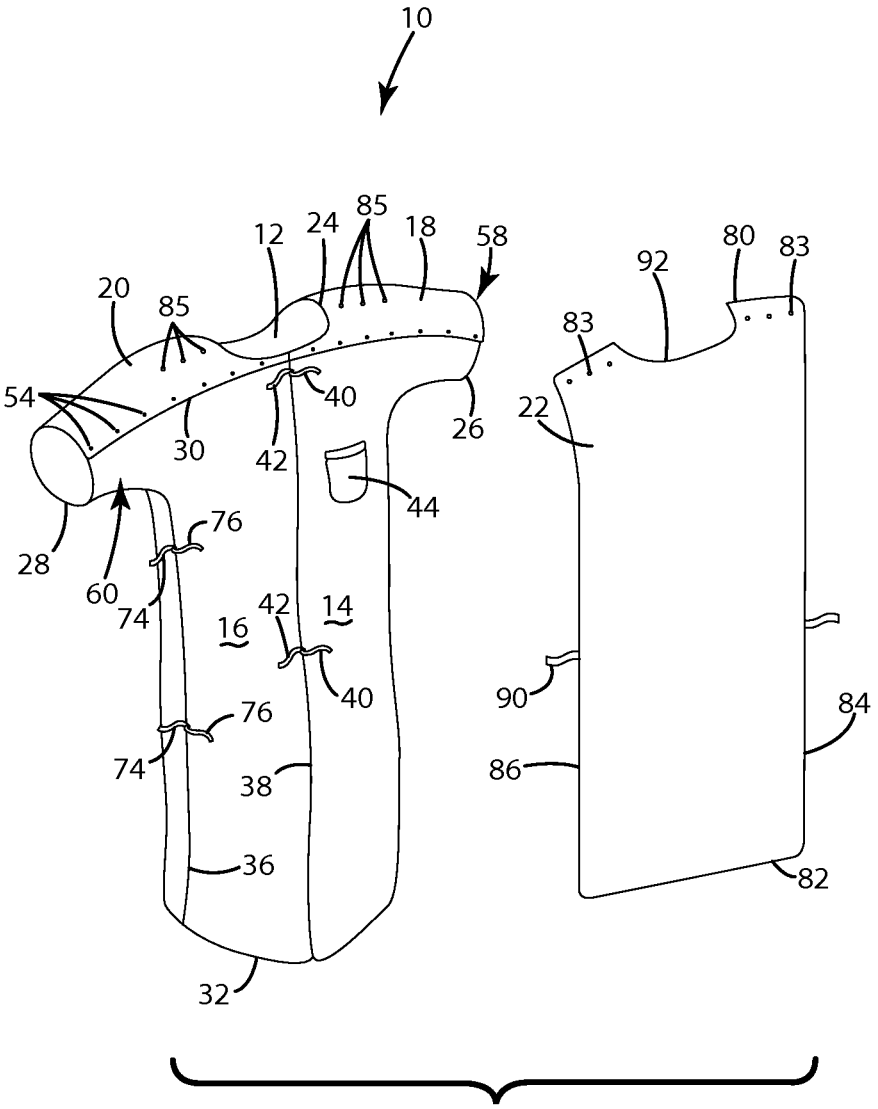
FIG. 1 is a perspective view of a hospital gown.

More specifically, and with reference to FIG. 1, an improved hospital gown is generally designated 10. The hospital gown 10 includes a back panel 12, left and right front panels 14, 16, left and right shoulder panels 18, 20, and a bib or apron 22. The back panel 12 and left and right shoulder panels can cooperatively define a neck opening 24, and the back panel, left and right shoulder panels 18, 20, and left and right front panels 14, 16 can cooperatively define left and right arm openings 26, 28. The hospital gown 10 can drape downward to a patient's knee or ankle to accommodate patients of various sizes while also simplifying access to the patient for medical treatment or evaluation.

Figure 2:
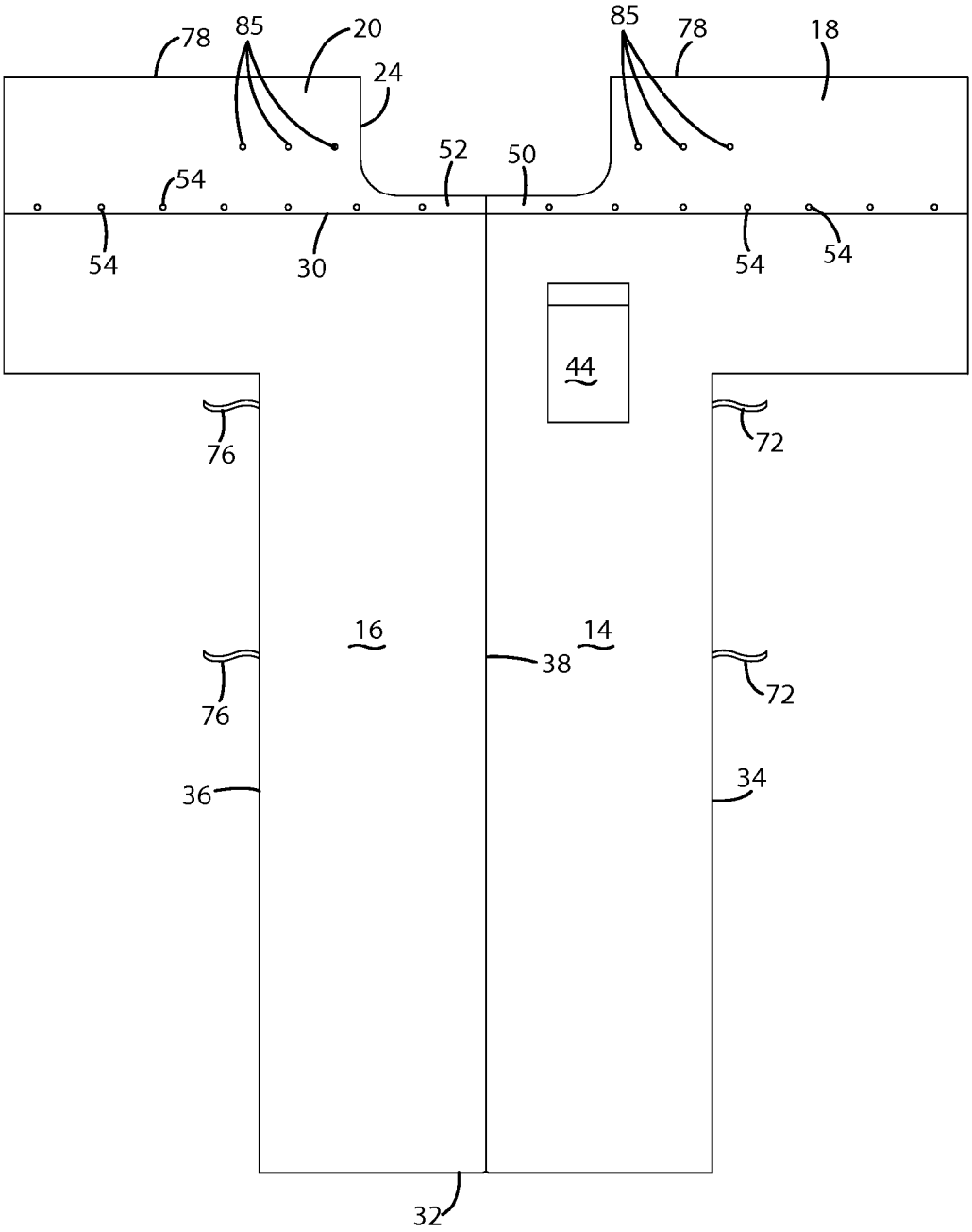
FIG. 2 is a front plan view of the hospital gown of FIG. 1.
Figure 3:
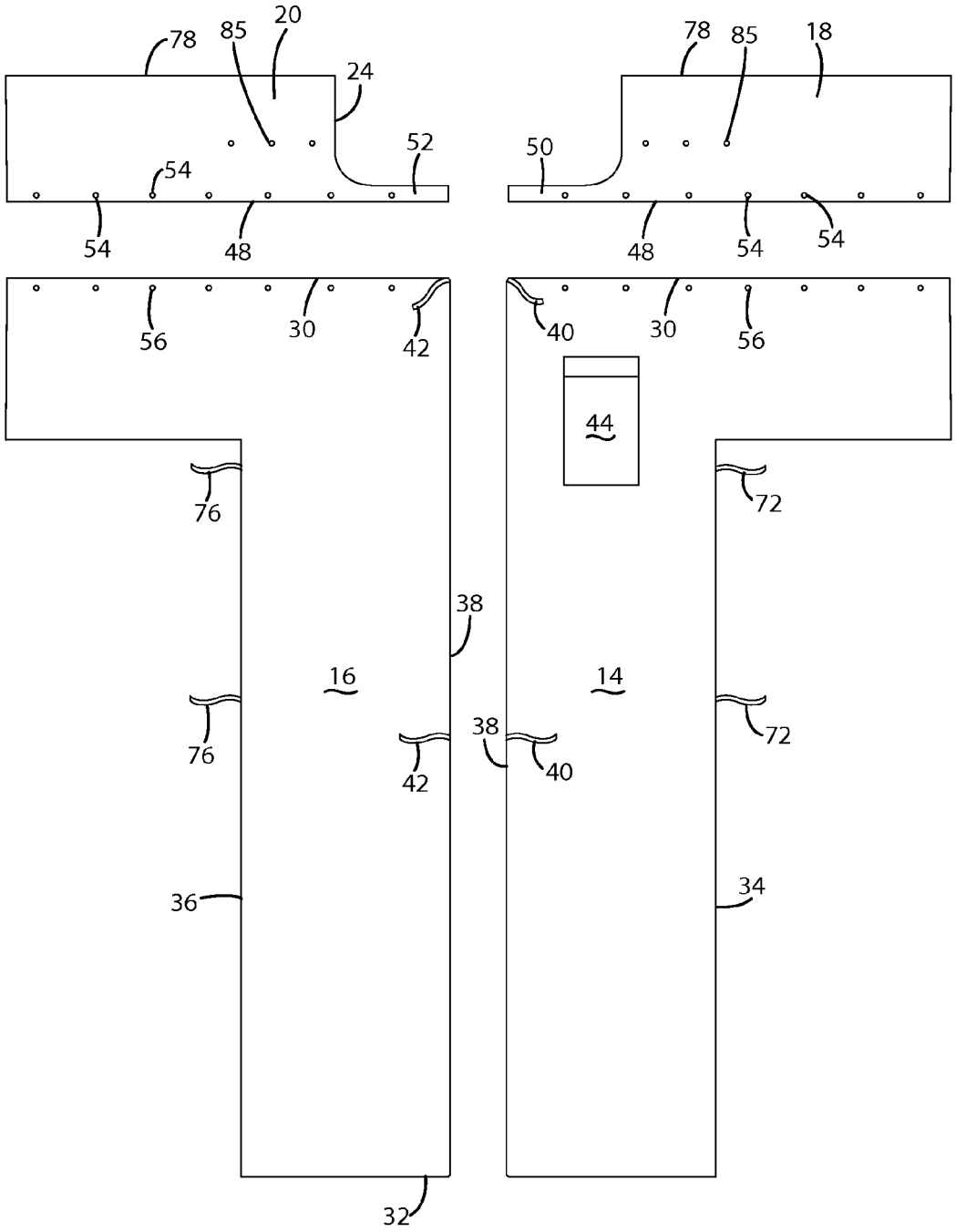
FIG. 3 is an exploded front plan view of the hospital gown of FIG. 1.
Figure 6:
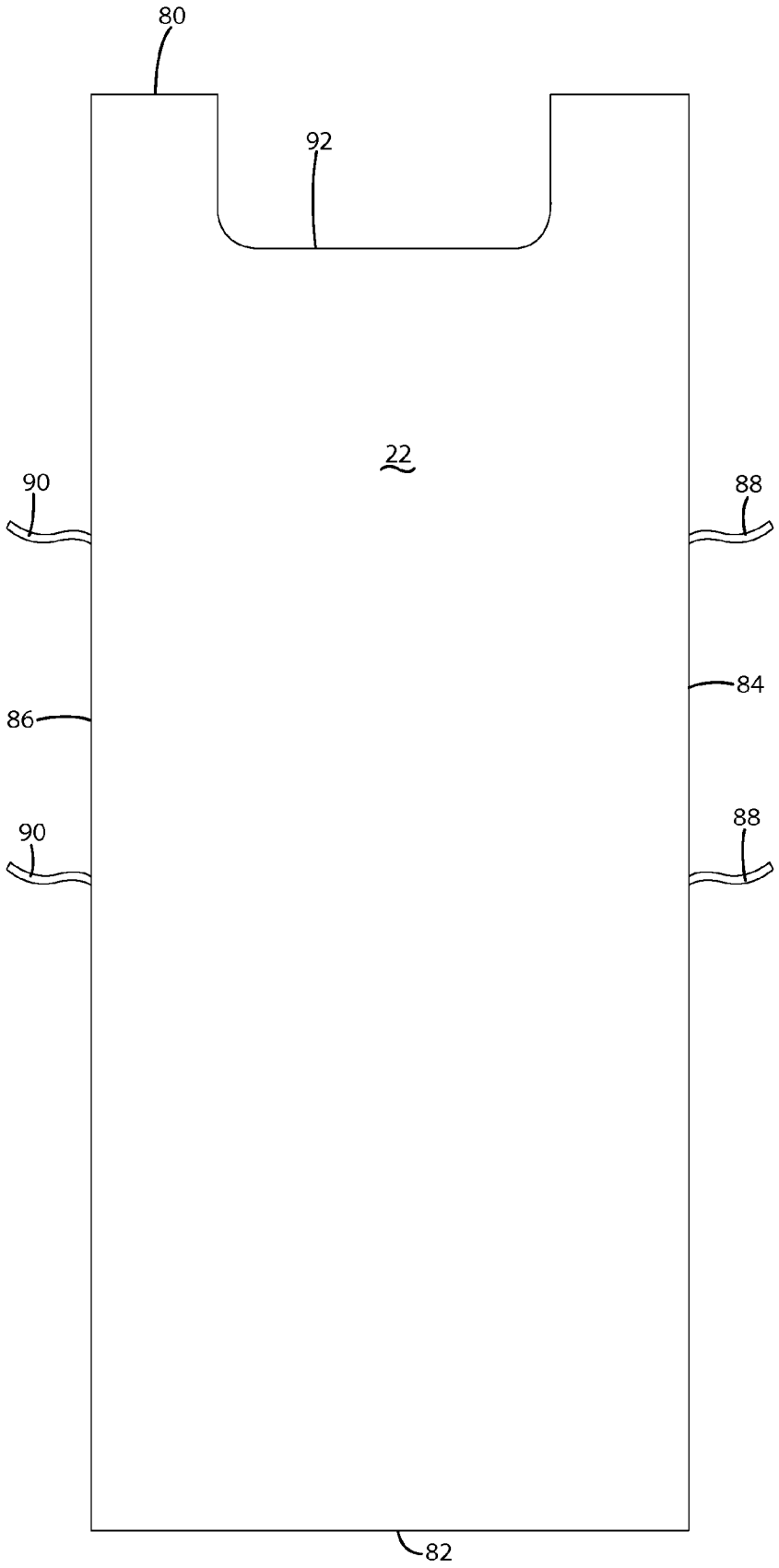
FIG. 6 is a front plan view of the apron for the hospital gown of FIG. 1.

Referring now to FIGS. 2-3, the front portion of the hospital gown 10 is shown. The left and right front panels 14, 16 cooperatively define a front top edge 30 and a front bottom edge 32. In addition, the left front panel 14 defines a front left edge 34 and the right front panel 16 defines a front right edge 36. When positioned adjacent each other, the left and right front panels 14, 16 define a generally vertical seam or opening 38 between the front left edge 34 and the front right edge 36. One or more fasteners can join the left front panel 14 to the right front panel 16 along the vertical opening 38. For example, the hospital gown 10 can include one or more left ties 40 extending from the left front panel 14 and one or more corresponding right ties 42 extending from the right front panel 16 to form tie closures for releasably joining the left front panel 14 to the right front panel 16. In another embodiment, the left front panel 14 and the right front panel 16 can be a single panel. In this embodiment, the opening 38 can extend partially between the front top edge 30 and the front bottom edge 32. In still another embodiment, the front panels 14, 16 can instead be formed of three or more sections of suitable material. In addition, the front left edge 14 can optionally include a telemetry pocket 44 for receiving accessories. As shown in FIG. 6, for example, the telemetry pocket 44 can include a small slit or opening 46 for allowing heart monitor wires and similar medical related equipment to pass through the front left panel 14. Alternatively, the small opening 46 can instead be positioned behind the telemetry pocket 44. While shown as positioned on or over the front left panel 14, the optional telemetry pocket 44 can be located in any suitable position and/or orientation as desired. The telemetry pocket 44 can be attached to the left front panel 14 or other surface according to any number of conventional stitching methods and may be sized appropriately for holding hospital telemetry.

Referring again to FIGS. 2-3, the hospital gown 10 includes left and right shoulder portions 18, 20. The left and right shoulder portions 18, 20 each include a front edge 48 detachably joined to the front top edge 30 of the left and right front panels 14, 16, respectively. The front edge 48 can be coextensive with the top edge 30, generally extending from the left arm 26 opening to the right arm opening 28. In one embodiment, the left shoulder portion 18 includes a left collar portion 50 and the right shoulder portion 20 can include a right collar portion 52. In other embodiments, however, the left and right front panels 14, 16 cooperatively define a portion of the neck opening 24. Each of the left and right shoulder panels 18, 20 can include a series of fasteners 54 to detachably connect the left and right shoulder panels 18, 20 with the left and right front panels 14, 16, respectively. The fasteners 54 can be any suitable closure, including for example snaps, hook and loop connectors, buttons, and ties. The left and right front panels 14, 16 can include a corresponding set of fasteners 56 for cooperative engagement with the shoulder panel fasteners 54. Optionally, the fasteners 54, 56 are snaps extending in generally equal intervals along the front upper edge 30 between the left arm opening 26 and the right arm opening 28. In addition, the left and right shoulder panels 18, 20 can each form a portion of a corresponding left and right sleeve 58, 60 extending from a torso portion of the garment 10.

Figure 4:
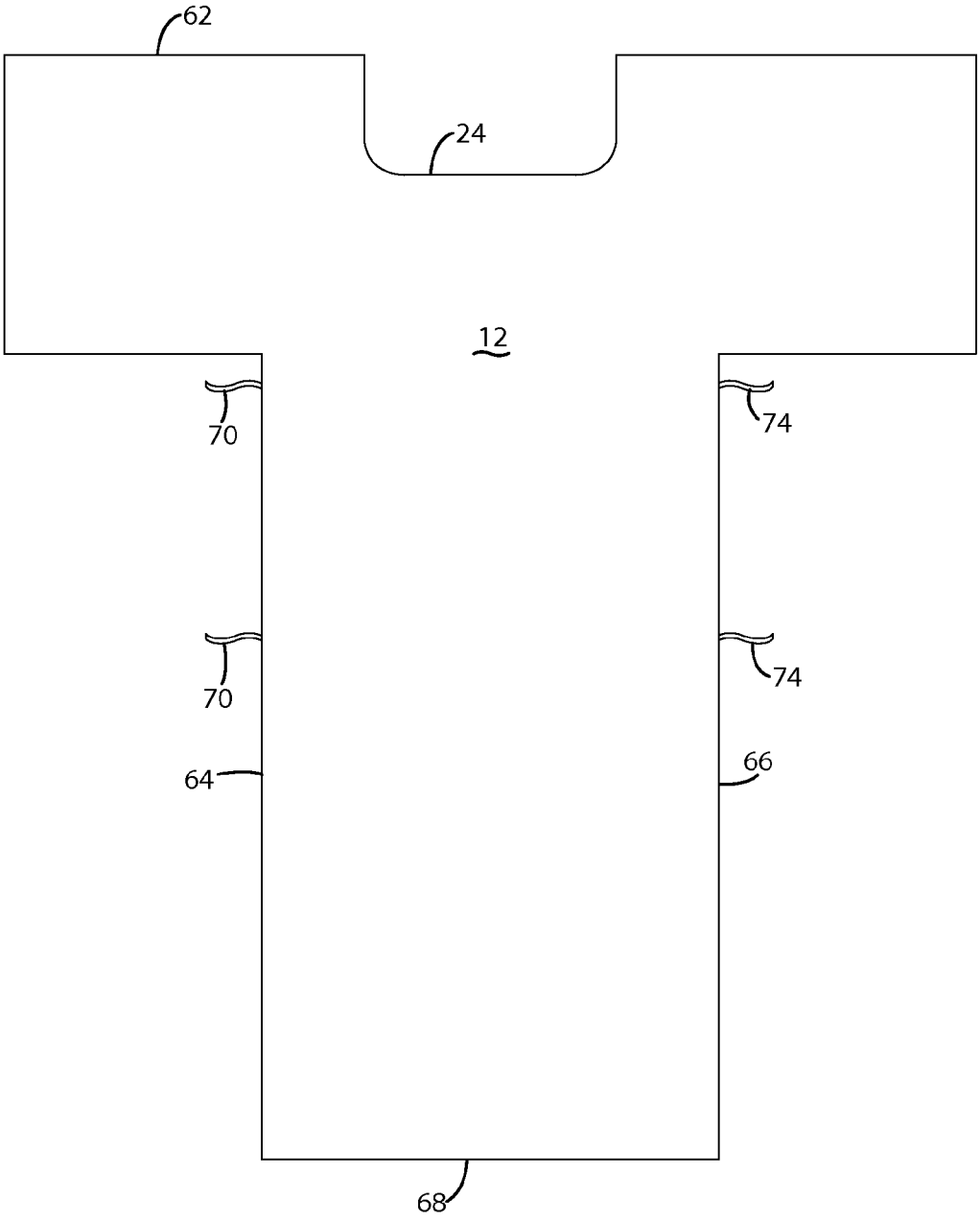
FIG. 4 is a rear plan view of the hospital gown of FIG. 1.
Figure 5:
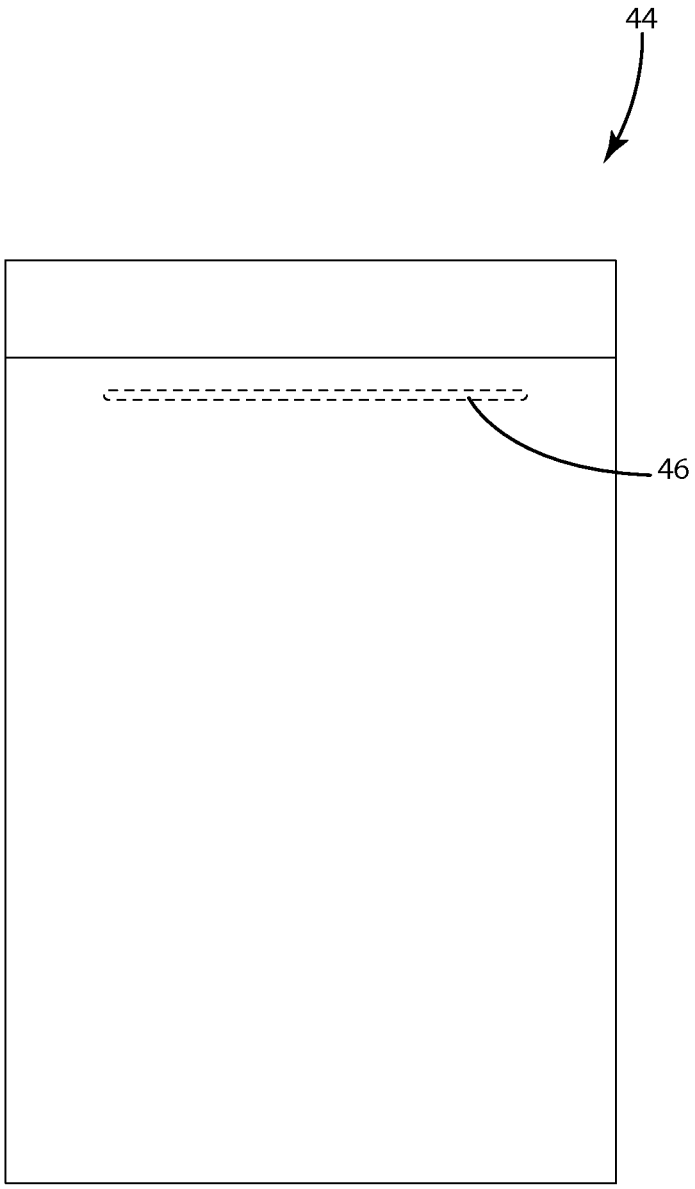
FIG. 5 is a front plan view of the telemetry pocket for the hospital gown of FIG. 1.

As shown in FIG. 4, the hospital gown 10 includes a back panel 12 having a back top edge 62, a back bottom edge 64, a back left edge 66 and a back right edge 68. Though shown as a single panel, the back panel 12 can instead be formed of two or more sections of suitable material. The back top edge 62 and the back bottom edge 64 can be spaced apart by a distance generally equal to the distance separating the front top edge 30 and the front bottom edge 32. In addition, the back left edge 66 and the back right edge 68 can be spaced apart by a distance generally equal to the distance separating the front left edge 34 and the front right edge 36. In one embodiment, the back panel 12 is fixedly joined to the left and right front panels 14, 16. For example, the back left edge 64 can be sewn to the front left edge 34 along its length, and the back right edge 66 can be sewn to the front right edge 36 along its length. In another embodiment, the back panel 12 is removably joined to the left and right front panels 14, 16. For example, a plurality of fasteners 70 can be disposed along or proximate the back left edge 64 adjacent a corresponding plurality of fasteners 72 disposed along or proximate the front left edge 34. In like manner, a plurality of fasteners 74 can be disposed along or proximate the back right edge 66 adjacent a corresponding plurality of fasteners 76 disposed along or proximate the front right edge 36. Though shown in FIG. 4 as ties, the fasteners 74, 76 can include any suitable closure, including for example snaps, hook and loop connectors, buttons and combinations thereof.

The back panel 12 can be fixedly or releasably joined to the left and right shoulder portions 18, 20 substantially along their length. In one embodiment, the back panel 12 is suitably sewn to the left and right shoulder portions 18, 20. In another embodiment, the back panel 12 and the left and right shoulder portions 18, 20 are formed from a single sheet of material. In still another embodiment, the back panel 12 and the left and right shoulder panels 18, 20 are joined using one or more fasteners. In this embodiment, the left and right shoulder panels 18, 20 each include a back edge 78 detachably joined to the back panel top edge 62. The back edge 78 can be coextensive with the back panel top edge 62, generally extending from the left arm 26 opening to the right arm opening 28. Thus, the back panel 12, the left front panel 14 and the left shoulder panel 18 cooperatively form the left sleeve 58 and define the left arm opening 26. In like manner, the back panel 12, the right front panel 16 and the right shoulder panel 20 cooperatively form the right sleeve 60 and cooperatively define the right arm opening 28. In addition, the back panel 12, the left shoulder panel 18 and the right shoulder panel 20 cooperatively form a collar to define a neck opening 24.

Referring now to FIG. 6, the bib or apron 22 is shown. The apron 22 is generally shaped to extend over at least a substantial portion of the vertical opening 38 in the hospital garment 10. In particular, the apron 22 includes a top edge 80, a bottom edge 82, a left side edge 84 and a right side edge 86. In one embodiment, the apron 22 is formed of a single sheet of material. In another embodiment, the apron 22 is formed of two or more sheets of material. The apron top edge 80 and the apron bottom edge 82 can be spaced apart by a distance generally equal to or less than the distance separating the front top edge 30 and the front bottom edge 32. In addition, the apron left edge 84 and the apron right edge 86 can be spaced apart by a distance generally equal to, less than, or greater than the distance separating the front left edge 34 and the front right edge 36. A plurality of left side fasteners 88 can be disposed along or proximate the apron left edge 84 adjacent a corresponding plurality of fasteners 70 disposed along or proximate the back left edge 64. In like manner, a plurality of right side fasteners 90 can be disposed along or proximate the apron right edge 86 adjacent a corresponding plurality of fasteners 74 disposed along or proximate the back right edge 66. Though shown in FIG. 6 as ties, the left and right side fasteners 88, 90 can be any suitable closure, including for example snaps, hook and loop connectors, buttons and combinations thereof. In addition, the upper portion of the apron 22 can define an opening 92 dimensioned to allow passage of the apron 22 over the head of a wearer. In other embodiments, the apron 22 is configured with one or more fasteners or closures 83 to releasably join the apron 22 to a corresponding one or more fasteners or closures 85 on an upper portion of the hospital gown 10.

During normal use, the shoulder panels 18, 20 generally support the garment 10 from the shoulders of the patient, and may be worn by ambulatory patients and by non-ambulatory patients. The hospital gown 10 can facilitate access to a patient's body simply by removing all or a portion of the apron 22 and folding back all or a portion of one or more front panels 14, 16. In this regard, the hospital gown 10 provides isolated access to specific portions of the patient's body. The hospital gown 10 may also be formed of any suitable material. For example, the hospital gown 10 may include a cotton blend, a synthetic fabric or combinations thereof. The hospital gown 10 may be manufactured in different sizes, and can be sized in length to extend to at least the patient's thighs.

The above descriptions are those of the current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A privacy gown comprising:

a one piece back panel;

a two piece front panel including a left front section defining a left front edge and a right front section defining a right front edge, wherein the left front section is detachably joined to the one piece back panel along the left front edge and wherein the left front section is re-joinable to the one piece back panel along the left front edge, and wherein the right front section is detachably joined to the one piece back panel along the right front edge and wherein the right front section is re-joinable to the one piece back panel along the right front edge;

left and right shoulder panels joined to the one piece back panel and the two piece front panel to cooperatively form left and right arm openings, wherein the left and right front sections are individually removable from the left and right shoulder panels, from each other and from said one piece back panel to permit access to the patient's body;

an apron having a top edge, a bottom edge, a left side edge, a right side edge and a planar body designed to extend over the two piece front panel;

said apron includes an upper left edge and an upper right edge each being removably detachable and re-joinable to the left and right shoulder panels, respectively; and said left side edge and right side edge of apron being removably detachable and re-joinable in a manner that does not damage the gown to the front panel.

2. The privacy gown of claim 1 further comprising a plurality of snaps to detachably join the left and right shoulder panels to the two piece front panel so that the upper left edge and an upper right edge are removably detachable and re-joinable to the left and right shoulder panels, respectively.

3. The privacy gown of claim 1 wherein the two piece front panel includes a telemetry pocket.

4. A privacy gown comprising:

a one piece back panel;

a two piece front panel including a left front section defining a left front edge and a right front section defining a right front edge, wherein the left front section is detachably joined to the one piece back panel along the left front edge and wherein the left front section is re-joinable to the one piece back panel along the left front edge, and wherein the right front section is detachably joined to the one piece back panel along the right front edge and wherein the right front section is re-joinable to the one piece back panel along the right front edge;

said two piece front panel further having a front top edge and front bottom edge;

left and right shoulder panels joined to the one piece back panel and the two piece front panel to cooperatively form left and right arm openings, wherein the left and right front sections are individually removable from the left and right shoulder panels, from each other and from said one piece back panel to permit access to the patient's body;

an apron designed to extend over the two piece front panel;

said apron includes an upper left edge and an upper right edge each being removably detachable and re-joinable to the left and right shoulder panels, respectively;

said apron top edge and said apron bottom edge being spaced apart by a distance generally equal to the distance separating the front top edge and the front bottom edge of the front panel;

said apron left edge and said apron right edge being spaced apart by a distance generally equal to the distance separating the left front edge and the right front edge of the front panel; and said left side edge and right side edge of apron being removably detachable and re-joinable in a manner that does not damage the gown to the front panel.

5. The privacy gown of claim 4 further comprising a plurality of snaps to detachably join the left and right shoulder panels to the two piece front panel so that the upper left edge and an upper right edge are removably detachable and re-joinable to the left and right shoulder panels, respectively.

6. The privacy gown of claim 4 wherein the two piece front panel includes a telemetry pocket.

7. A privacy gown comprising:

a one piece back panel;

a two piece front panel including a left front section defining a left front edge and a right front section defining a right front edge, wherein the left front section is detachably joined to the one piece back panel along the left front edge and wherein the left front section is re joinable to the one piece back panel along the left front edge, and wherein the right front section is detachably joined to the one piece back panel along the right front edge and wherein the right front section is re-joinable to the one piece back panel along the right front edge;

said two piece front panel further having a front top edge and front bottom edge;

left and right shoulder panels joined to the one piece back panel and the two piece front panel to cooperatively form left and right arm openings, wherein the left and right front sections are individually removable from the left and right shoulder panels, from each other and from said one piece back panel to permit access to the patient's body;

an apron designed to extend over the two piece front panel;

said apron includes an upper left edge and an upper right edge each being removably detachable and re-joinable to the left and right shoulder panels, respectively;

said apron top edge and said apron bottom edge being spaced apart by a distance generally equal to the distance separating the front top edge and the front bottom edge of the front panel;

said apron left edge and said apron right edge being spaced apart by a distance generally equal to the distance separating the left front edge and the right front edge of the front panel;

said left and right shoulder panels each having a front edge with a plurality of snaps located thereon for detachably joining the front edges of the left and right shoulder panels to a plurality of corresponding snaps located on the front top edge of the two piece front panel;

said upper left edge of apron being detachably connectable to the left shoulder panel via a plurality of snaps located superior to the front edge of the left shoulder panel;

said upper right edge of apron being detachably connectable to the right shoulder panel via a plurality of snaps located superior to the front edge of the right shoulder panel; and said left side edge and right side edge of apron being removably detachable and re-joinable in a manner that does not damage the gown to the front panel.

8. The privacy gown of claim 7 wherein the two piece front panel includes a telemetry pocket.

* * * * *